United States Patent [19]

Evertson

[11] Patent Number: 5,018,341

[45] Date of Patent: May 28, 1991

[54] MOLDED SADDLE PAD WITH ENCAPSULATED LAYERS

[75] Inventor: Sarah K. Evertson, Ipswich, Mass.

[73] Assignee: Equine Innovations, Inc., Newbury, Mass.

[21] Appl. No.: 415,901

[22] Filed: Oct. 2, 1989

Related U.S. Application Data

[63] Continuation-in-part of Ser. No. 297,411, Jan. 13, 1989.

[51] Int. Cl.[5] ..... B68C 1/12

[52] U.S. Cl. ..... 54/66

[58] Field of Search ..... 54/65, 66

[56] References Cited

U.S. PATENT DOCUMENTS

| | | | |
|---|---|---|---|
| 7,557 | 3/1877 | Spencer | 54/66 |
| 402,480 | 4/1889 | Robbins | 54/66 |
| 1,357,823 | 11/1920 | Read . | |
| 2,072,188 | 3/1937 | Tauber | 54/66 |
| 3,971,194 | 7/1976 | Morgan | 54/66 |
| 4,669,255 | 6/1987 | Wicks | 54/66 |
| 4,683,709 | 8/1987 | Vasko et al. | 54/66 |
| 4,695,496 | 9/1987 | Lee | 54/66 X |
| 4,765,126 | 8/1988 | Bates | 54/44 |
| 4,827,701 | 5/1989 | Gonzales | 54/66 |
| 4,974,397 | 12/1990 | Ricken | 54/66 |

FOREIGN PATENT DOCUMENTS

| | | | |
|---|---|---|---|
| 426078 | 3/1935 | United Kingdom | 54/66 |
| 434459 | 9/1935 | United Kingdom | 54/66 |

OTHER PUBLICATIONS

Advertisement from Libertyville Saddle Shop, Inc. Sales Catalog, Nov. 1988.

Advertisement from *Equus*, vol. 144, p. 23 (Oct. 1989).

*Primary Examiner*—Robert P. Swiatek

*Attorney, Agent, or Firm*—Hamilton, Brook, Smith & Reynolds

[57] ABSTRACT

The present invention provides a back pad having an encapsulated design contoured to fit between a saddle pad on a horse's back and a saddle, having a pronounced cushioning action which affords comfort both to the horse and rider by absorbing the shocks caused by the concussive impact of the horse's movement and the rider's movement. The pad is a unitary, molded pad made from a shock-absorbing polymeric material, having a raised area in the portion which rises over the horse's withers, a central channel which runs longitudinally down the center of the pad, which channel has several ventilating holes, and raised cushioning portions disposed laterally on each side of the channel, the cushioning portions having encapsulated therein one or more shock-absorbing layers and a layer of air, which encapsulated cushioning portions absorb shocks, minimize soreness of the horse caused by the saddle, and lift the front panels of the saddle away from the horse's shoulders, allowing the horse to move more freely.

15 Claims, 2 Drawing Sheets

MOLDED SADDLE PAD WITH ENCAPSULATED LAYERS

RELATED APPLICATION

This application is a continuation-in-part of co-pending U.S. application Ser. No. 07/297,411, filed Jan. 13, 1989.

BACKGROUND OF THE INVENTION

Heretofore, it has been customary to use pads of felt or fabric or a blanket between an ordinary riding saddle and a horse's back. The primary purpose of the pad, or blanket, is to prevent the saddle from chafing the horse, and the secondary purpose is to provide cushioning and protection for the horse's back. These back pads or blankets do not serve particularly well the purposes for which they are used, especially the cushioning of shocks and pressure on the horse's back resulting from saddle contact and the rider's seat and legs.

Presently commercially available saddle pads made from flexible polymeric materials are available, however, these suffer from several shortcomings. For example, many commercially available pads are made from two or more layers of material which are glued together. These layers can slip past each other over time, or delaminate. The adhesives used to hold the layers together it often contains materials which are toxic to the animal and the rider. These adhesives may leak due to improper construction of the layered pad or adhesive failure, and cause rashes and/or allergic reactions in the horse or rider who is exposed to them.

In addition, many commercially available saddle pads restrict the horses movement due to improper sizing or design.

SUMMARY OF THE INVENTION

The present invention relates to a back pad for use under saddles which is a unitary, molded pad having shock-absorbing material encapsulated therein. The pad and shock-absorbing layers are formed of a flexible, shock absorbant polymeric material. One or more layers of shock-absorbing material are encapsulated within the raised portions of the pad. These inner layers are not adhered together, but float freely within the raised portions, and are surrounded by a thin layer of air. The present encapsulated design provides superior comfort for both the horse and rider by absorbing the shocks caused by the concussive impact of the horse's movement and the movement of the rider.

The pad of the present invention with the encapsulated layers is formed by compression molding of a flexible, shock-absorbing polymeric material, such as foamed cross-linked polyethylene. The inner encapsulated layers are formed from a flexible, shock-absorbing polymeric material and are encapsulated during the compression molding process thus the pad is formed is a single unitary outer shell in which the shock-absorbing layers are completely encapsulated.

The entire area of the pad serves to evenly disperse the rider's weight and the saddle's weight across the horse's back, thereby reducing shock and pressure points. The presence of the encapsulated inner layers significantly improves the shock-absorbing action of the pad by allowing the concussive impact to be absorbed independently throughout the separate layers of the pad. The pad is designed to have thicker raised panel portions, which contain the encapsulated layers, which correspond to the areas a saddle comes into contact with a horse's back and shoulders. These raised panel portions are positioned to provide extra cushioning and protection over the shoulders and on either side of the spine, where a saddle and the rider's weight put pressure, thereby minimizing soreness or discomfort due to back pain. There is also a raised area which protects the horse's withers. A raised centered channel with die cut holes allows for air circulation and reduces pressure on the spine.

The present back pad better serves to prevent chafing and soreness and minimizes pressure points caused by ill-fitting saddles and the rider's weight, while increasing the comfort level of both horse and rider. The back pad of the present invention cushions and protects the muscles along the horse's spine and over its shoulders. In addition, the encapsulated design of the back pad improves a horse's movement by allowing the horse's shoulders to move freely by lifting the front panels of the saddle away from the horse's shoulders. The encapsulated shock-absorbing layers are surrounded by a layer of air which significantly improves the shock-absorbing action of the pad. The ventilating openings in the channel area permits maximum air circulation.

DETAILED DESCRIPTION OF THE INVENTION

The present invention provides a back pad having a unique encapsulated design, which is made to fit between a saddle and a conventional saddle pad or other covering. The back pad is used by placing it between the saddle pad or covering which is directly in contact with the horse's back, and the saddle. The pad has a pronounced cushioning action where it will afford comfort both to the horse and rider by absorbing the shocks caused by the concussive impact of the horse's movement and the movement of the rider. The encapsulated design of the pad of the present invention significantly increases the horse's comfort level by reducing pressure points caused by ill-fitting saddles and improves the horse's movement by allowing for free shoulder action by preventing the saddle's panels from pressing into the horse's shoulders. The present pad has encapsulated, shock-absorbing layers which float freely within the raised portions of the pad, and are therefore surrounded by a thin layer of air. The encapsulated design significantly improves the shock-absorbing action of the present pad by allowing the concussive impact to be absorbed independently throughout the separate layers of the pad.

Figure 1:
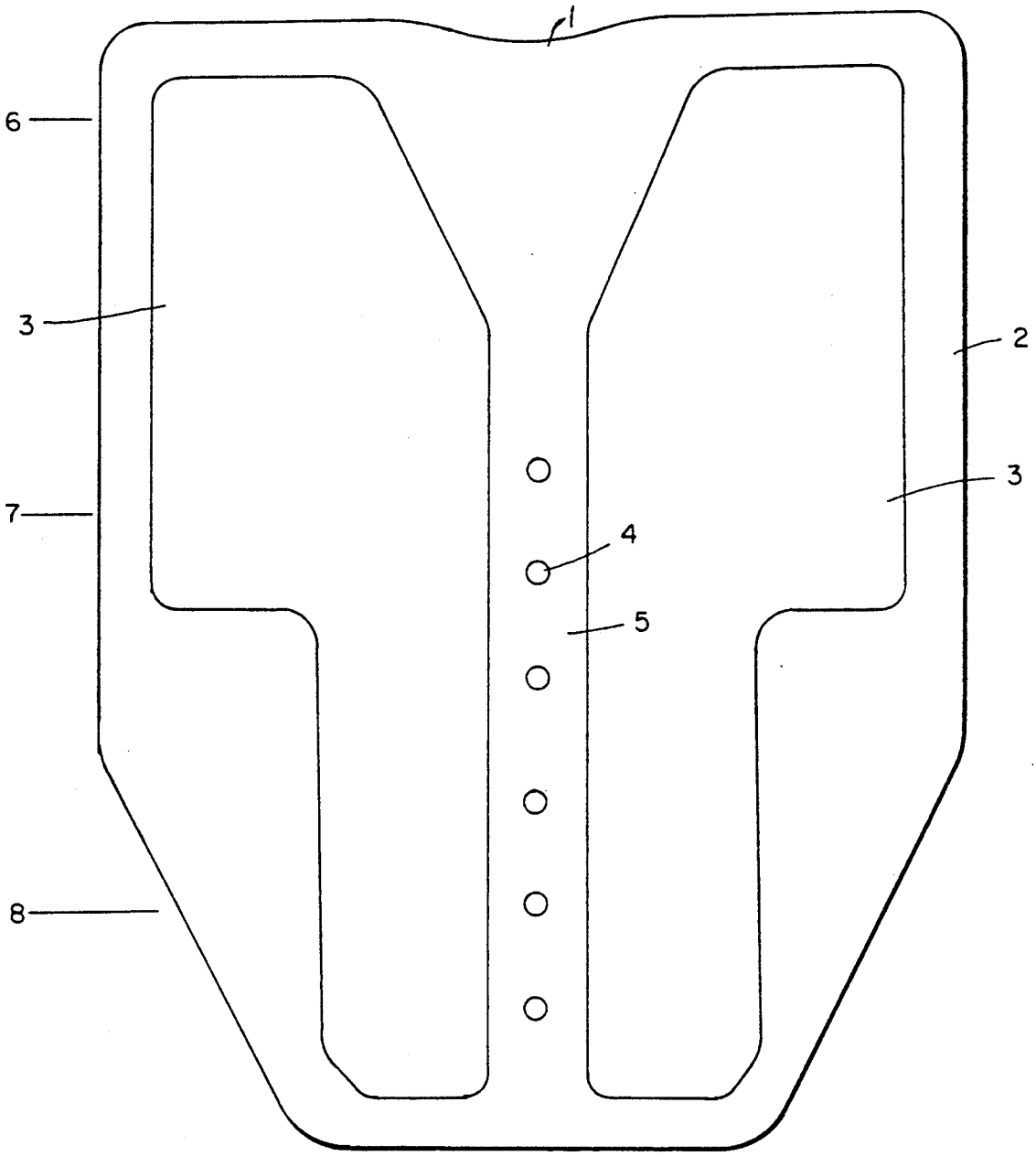
FIG. 1 is a top view of the back pad of the present invention.
Figure 2:
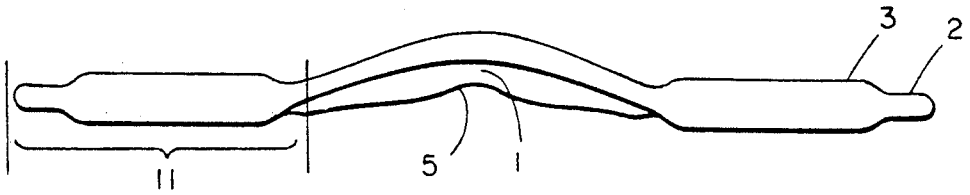
FIG. 2 is a side view taken from the front of the pad, showing the contour of the raised withers area of the pad.
Figure 3:
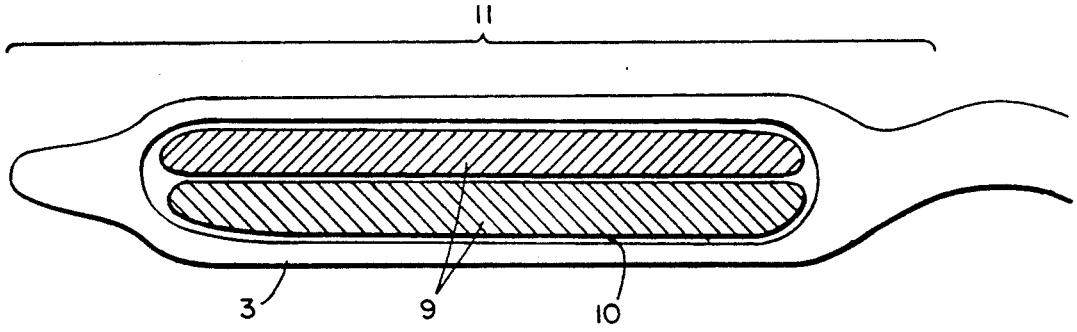
FIG. 3 is a magnified sectional view of the cushioning portion taken from one side of the front of the pad, showing the encapsulated layers of shock-absorbing material and the layer of air.

FIGS. 1, 2 and 3 illustrate the components of the back pad of the present invention: the back pad has substantially the contour of the saddle and comprises a front portion 6, a mid-portion 7 and an inwardly tapered rear portion 8. The rear portion 8 can also be straight, rather than tapered. The front portion 6 has a centrally located raised area 1 which fits over the withers area of the horse and which generally corresponds to the pommel area of the saddle.

The raised cushioning panels or portions 3 are disposed laterally on each side of the pad. As shown in FIG. 1, the cushioning portions 3 are unitary, elongated and extend from the front portion 6 of the pad rearward through the mid-portion 7 to approximately the rear portion 8. The cushioning portions 3 extend laterally from the outer edges 2 of the pad inwardly to approximately the channel area 5. As shown in FIG. 1, the cushioning portions 3 are substantially L-shaped and have a narrower section extending from the rear portion 8 of the pad forward to the mid-portion 7 of the pad, and a wider section extending from the mid-portion 7 of the pad forward to the front portion 6. As shown in FIG. 2, the cushioning portions 3 are raised such that they are thicker than the outer edges 2 of the pad.

FIG. 3 is a magnified sectional view 11 of one of the cushioning portions 3. As shown in FIG. 3, the cushioning portions 3 contain one or more shock absorbing layers 9 which are completely encapsulated by the pad. The inner layers 9 are not adhered together, rather, they float freely within the raised panel portions 3 and are surrounded by a thin layer of air 10.

A channel area 5 runs longitudinally from the raised withers area 1 rearward to approximately the rear portion 8 of the pad. This channel area allows for the passage of moisture between the horse's back and the saddle and relieves pressure from the spine of the horse. The channel area has therein, as shown, a plurality of openings 4. These openings provide ventilation, and as shown in FIG. 1, are die cut holes linearly positioned and running the length of the channel area 5 from the front portion 6 through the mid-portion 7 to the rear portion 8 of the pad. These ventilating openings can be of any shape, or number, which serve the purpose of providing ventilation to the area underneath the saddle, and allowing the passage of moisture therefrom.

The back pad is formed of a crosslinked, flexible, shock-absorbant polymeric material, such as foamed, closed-cell polyolefin, e.g. polypropylene or polyethylene. The polymeric material should preferably be closed-cell in order to resist moisture absorption. Open-cell foams can absorb moisture which reduces the effectiveness and comfort of the pad.

The polymeric material should preferably be crosslinked to provide stability over a wide range of temperatures and to resist attack by environmental factors such as ultraviolet light. Crosslinking refers to interchain-linking between polymer chains which forms a network, and which prevents the polymer chains from sliding past one another. Crosslinked polymer chains have limited movement relative to each other. The crosslinked network extending throughout the polymer is stable to heat and cannot be made to flow or melt.

For example, crosslinking polyethylene enhances the polymer's form stability, tensile strength, resistance to flow (and, therefore to deformation), and resistance to stress cracking. In contrast thermoplastic (i.e., non-crosslinked) linear or branched polymers can flow under some conditions; that is, can be made to soften and take on new shapes by the application of heat and pressure.

The polymeric material should also be shock-absorbant, tear-resistant and provide a non-skid surface to reduce or eliminate slippage. Finally the polymeric material must be compression-moldable. A polymeric material which provides all of these requirements is a crosslinked, closed-cell polyethylene, such as Evalite®, produced by Monarch Rubber Co., Inc. Crosslinked polyethylene foams are described in detail in *Modern Plastics Encyclopedia,* vol 65, McGraw Hill, Inc., New York (1988).

The shock-absorbing layers encapsulated in the raised portions of the pad are formed of a flexible, shock-absorbing polymeric material. For example, foamed polymeric materials can be used. Crosslinked polyolefin foams, e.g., polypropylene, polyethylene and poly(-vinylnitrile) foams are particularly useful as shock absorbing materials. Optionally, the shock-absorbing layers can be formed of a polymer having a higher density than the pad.

The pad is of unitary construction, formed from a single sheet of polymeric material having the shock-absorbing layer or layers encapsulated in the raised panel portions. The pad is formed by the art-recognized technique of compression molding. The shock-absorbing layers are encapsulated during compression molding of the pad. Compression molding generally involves putting the polymeric material between stationary and moveable members of a mold. The mold is closed, heat and pressure are applied so that the material become plastic, flows to fill the mold, and becomes a homogeneous mass. The necessary pressure and temperature vary considerably depending upon the rheological properties of the polymer. For a typical compression-molding material, the temperature may be approximately 150° C. and the pressure from about 1000–3000 psi. Compression molding techniques are described in the *Modern Plastics Encyclopedia,* vol. 65, pp. 234–238, McGraw Hill, Inc. New York (1988).

In the compression molding technique used to produce the present encapsulated pad, the shock-absorbing layers are placed between layers of the polymeric material which form the body of the pad. As the polymer flows and expands in the mold, the shock-absorbing layers and the layer of air become surrounded by the polymer, forming a capsule. The pad as removed from the mold is a single, bonded, unitary pad with the shock-absorbing layers and air layer encapsulated in the raised panel portions, which formed around them. A compression-molding technique which is particularly useful for encapsulating the shock-absorbing layers is available, for example, from Ohio Cellular Products, Waseon, Ohio.

As an illustrative example in a back pad for a horse and saddle of normal size, the length of the pad may be approximately 22 to 26 inches, the width of the pad at the front section thereof may be approximately 17 inches, the width at the rear section 8 may be approximately 9 to 17 inches, the length of the raised cushioning portions 3 may be approximately 18–24 inches, the width of the narrower portion of the cushioning portions 3 may be approximately 5 to 6½ inches, the width of the channel area 5 may be approximately 1½ to 2 inches the length of the channel area 5 may be approximately 16 to 26 inches, and the number of openings 4 may be about 6 to 10 inches. The raised withers area 1 may be a substantially v-shaped area, which is approximately 5½ to 6 inches long, and the narrower portion of the v-shaped raised withers area which is located at the front end of the channel area 5, can be about 1½ inches wide, and wider portion, which is located at the front end of the pad, can be approximately 5 to 6½ inches wide.

The encapsulated cushioning portions 3 containing the shock-absorbing layer or layers 9 and the air layer 10 effectively cushion the impact of the spine and shoulders of the horse caused by the concussive impact of the horse's hoof striking the ground and the rider's active downward pressure. This interplay of concussive forces, possibly in addition to poor or uneven muscle development in the horse, the rider's weight and balance and an ill-fitting saddle can put severe stress on the horse's back and shoulders, and can cramp the horse's movement, reduce performance or even cause lameness. The encapsulated design of the present back pad cushions and protects the muscles along the horse's spine and shoulders. The present encapsulated design is particularly effective for this purpose because the freely floating shock-absorbing layers surrounded by a layer of air allow the concussive impact to be absorbed independently throughout the separate layers, and the air layer 10 provides additional cushioning.

The raised withers area 1 of the present pad is designed to lift the front padding of the saddle away from the horse's shoulders, allowing freedom of movement. The channel area 5 reduces pressure of the horse's spine and permits maximum air circulation underneath the saddle. The openings in the channel area further allow for the passage of moisture from the horse's back, thereby increasing the comfort of the horse.

Finally the pad is very light weight, weighing only about 4 ounces.

The present combination of features and encapsulated design provides a back pad having superior cushioning, ventilation and more pronounced shock-absorbance for both horse and rider and reduces pressure on the horse's spine and shoulders, thereby allowing more freedom of movement.

EQUIVALENTS

Those skilled in the art will recognize, or be able to ascertain, using no more than routine experimentation, numerous equivalents to the specific substances and procedure described herein. Such equivalents are considered to be within the scope of this invention, and are covered by the following claims.

I claim:

1. A back pad for use under saddles comprising a unitary, single-layer molded pad which is formed of a flexible, shock-absorbant polymeric material further comprising:

a centrally located raised forward portion which rises over the withers area of the horse;

a centrally located channel area which runs the length of the pad from the withers area to the rear of the pad;

a plurality of openings perforating said channel area; and symmetrical raised cushioning portions located laterally on both sides of the pad in the areas which correspond to the areas where the saddle rests against the back and shoulders of the horse, said cushioning portions having encapsulated therein at least one layer of shock-absorbing material.

2. A back pad of claim 1 wherein said raised cushioning portions further contain a layer of air encapsulated therein.

3. The back pad of claim 1 wherein the polymeric material is a cross-linked, closed-cell foamed material.

4. The back pad of claim 3, wherein the polymeric material is cross-linked polyethylene.

5. The back pad of claim 3, which is compression molded.

6. The back pad of claim 4, which is compression molded.

7. The back pad of claim 1, wherein said cushioning portions encapsulating the said at least one shock-absorbing layer comprise unitary, elongated raised areas having a narrow portion extending from the rear portion of the pad to the mid-section of the pad, and a wider portion extending from the mid-section to the front portion of the pad, which cushioning portions are located on both sides of, and adjacent to said channel area, and extend laterally toward the outer edges of the pad.

8. The back pad of claim 7 wherein each of said cushioning portions is substantially L-shaped.

9. The back pad of claim 1, wherein the openings comprise a series of circular perforations centrally located in the channel area and running in a line from the raised withers area to the rear of the pad

10. The back pad of claim 1, wherein the raised forward portion which rises over the withers area is centrally located in the front portion of the saddle pad and corresponds generally to the pommel area of the saddle.

11. A molded back pad for a horse comprising a unitary, compression-molded pad which is formed of a flexible, shock-absorbant, cross-linked, closed-cell polymeric material, comprising:

a forward portion having therein a raised, centrally located portion over the withers area;

a centrally located channel area which runs longitudinally from the said raised withers area to the rear of the pad;

a plurality of openings perforating said channel area; and symmetrical substantially L-shaped raised cushioning portions located laterally on both sides of the pad, having a narrow portion running from the rear of the pad to the mid-section thereof, and a wider portion running from the mid-section to the front of the pad, said raised cushioning portions having encapsulated therein at least one layer of shock-absorbing material.

12. The back pad of claim 11 wherein the raised cushioning portions further contain a layer of air encapsulated therein.

13. The back pad of claim 11, wherein the polymeric material is cross-linked polyethylene.

14. The back pad of claim 11, wherein the openings comprise a series of circular perforations centrally located in the channel area and running in a line from the raised withers area to the rear of the pad.

15. The back pad of claim 11, wherein the channel area reduces pressure on the horse's spine.

* * * * *